US011623802B2

(12) United States Patent
Keane

(10) Patent No.: US 11,623,802 B2
(45) Date of Patent: Apr. 11, 2023

(54) COVID SAFE COOLING SYSTEMS

(71) Applicant: Scott K Keane, Lake Worth, FL (US)

(72) Inventor: Scott K Keane, Lake Worth, FL (US)

( * ) Notice: Subject to any disclaimer, the term of this patent is extended or adjusted under 35 U.S.C. 154(b) by 57 days.

(21) Appl. No.: 17/323,091

(22) Filed: May 18, 2021

(65) Prior Publication Data

US 2021/0362925 A1 Nov. 25, 2021

Related U.S. Application Data

(60) Provisional application No. 63/027,499, filed on May 20, 2020.

(51) Int. Cl.

| | |
|---|---|
| ***A45C 11/20*** | (2006.01) |
| ***A47G 23/02*** | (2006.01) |
| ***A47G 23/04*** | (2006.01) |
| ***B65D 81/18*** | (2006.01) |
| ***F25D 3/08*** | (2006.01) |
| ***F25D 3/06*** | (2006.01) |
| ***B65D 71/52*** | (2006.01) |
| ***B65D 43/16*** | (2006.01) |

(52) U.S. Cl.

CPC ..... *B65D 71/0003* (2013.01); *B65D 43/166* (2013.01); *B65D 81/18* (2013.01); *F25D 3/08* (2013.01); *B65D 2501/24929* (2013.01); *B65D 2501/24936* (2013.01); *F25D 2303/081* (2013.01)

(58) Field of Classification Search

CPC .. B65D 43/166; B65D 71/0003; B65D 81/18; B65D 2501/24929; B65D 2501/24936; B65D 25/108; F25D 3/08; F25D 2303/081; F25D 23/069; F25D 2303/0841

USPC ..... 206/427, 562, 139; 220/512, 592.16; 62/457.4, 457.5, 457.7

See application file for complete search history.

(56) References Cited

U.S. PATENT DOCUMENTS 56,978 A * 8/1866 Miller ..... F25D 3/08 222/131
1,652,600 A * 12/1927 Beers ..... F25D 31/007 15/210.1
2,024,648 A * 12/1935 Kissling ..... F25D 3/14 62/388

(Continued)

OTHER PUBLICATIONS

MaxiRough X-Frame Cart—Nexstep commercial products https://ocedarcommercial.com/products/cleaning-equipment/maxirough-x-frame-cart/ (Year: 2022).*

*Primary Examiner* — Gideon R Weinerth

(57) ABSTRACT

A covid protection cooler system is provided. The system includes a five-panel sided box structure. The box structure includes a back, bottom, front, left and right panels. The system also includes a top panel with back and side hinges. The back hinges allow the top panel to swivel between open and closed positions and the side hinges maintain the top panel in an open position for replenishing ice. The top panel includes a plurality of openings. The system includes a lock hasp positionable on the front panel and the top panel. The system includes a plurality of cylindrical container holders affixed to a top surface of the bottom panel. The exterior surfaces of the container holders and the interior surfaces of the five-panel box structure form an interior ice chamber. The system includes a water barrier liner on an interior surface of the ice chamber. System includes a drain plug.

1 Claim, 8 Drawing Sheets

(56) References Cited

U.S. PATENT DOCUMENTS 2,459,921 A * 1/1949 Comer ..... B65D 71/0003 229/122.22
2,556,844 A * 6/1951 Istwan ..... A47G 23/0641 206/139
2,562,108 A * 7/1951 Lutz ..... A61J 9/00 217/26
2,740,546 A * 4/1956 Kowalski ..... B65D 25/108 211/74
3,160,306 A * 12/1964 Smalley ..... B65D 85/305 220/512
4,360,105 A * 11/1982 Williams ..... A45C 11/20 206/544
5,333,751 A * 8/1994 Santucci, Sr. ..... B65D 25/108 229/120.32
5,901,571 A * 5/1999 Whaley ..... F25D 3/08 62/530
6,186,351 B1 * 2/2001 Coyle ..... F25D 3/08 220/23.88
6,851,276 B2 * 2/2005 Perrins ..... A45C 11/20 62/530
7,178,673 B1 * 2/2007 Miller ..... A45C 11/20 206/545
7,562,787 B2 * 7/2009 Serrano ..... B65D 71/0003 206/139
7,780,034 B1 * 8/2010 Richardson ..... F25D 3/08 206/199
7,861,552 B1 * 1/2011 Hughes ..... A45C 13/02 62/457.2
8,505,726 B1 * 8/2013 Woog ..... F25D 31/007 220/592.16
8,740,010 B1 * 6/2014 Page ..... F25D 23/02 220/592.2
8,997,995 B2 * 4/2015 Chitsazan ..... A47G 23/0208 206/541
D754,497 S * 4/2016 Chitsazan ..... A47G 23/0208 D7/705
9,423,168 B1 * 8/2016 Rosso ..... F25D 3/08
10,010,162 B1 * 7/2018 Woods ..... B65D 25/108
10,098,488 B2 * 10/2018 Boyatt ..... A47G 23/0641
10,151,520 B2 * 12/2018 Christensen ..... B62B 1/16
10,694,876 B2 * 6/2020 Boyatt ..... A47G 23/0616
11,141,012 B1 * 10/2021 Roffey ..... F25D 31/007
11,225,277 B1 * 1/2022 Sun ..... B62B 5/061
2004/0025530 A1 * 2/2004 Perrins ..... A45C 11/20 62/464
2005/0082303 A1 * 4/2005 Cantwell ..... A47G 23/0208 220/737
2008/0029526 A1 * 2/2008 Campbell ..... F25D 3/08 220/737
2008/0047296 A1 * 2/2008 Helmer ..... F25D 3/08 62/457.7
2008/0083352 A1 * 4/2008 Tovani ..... A47B 83/04 108/44
2008/0169292 A1 * 7/2008 Serrano ..... A47G 23/0208 206/139
2015/0175308 A1 * 6/2015 Christian ..... F25D 3/08 220/4.01
2019/0031421 A1 * 1/2019 Kneisel ..... B65D 43/164
2021/0362925 A1 * 11/2021 Keane ..... B65D 71/0003
2022/0055542 A1 * 2/2022 Kane ..... B60R 9/065
2022/0185393 A1 * 6/2022 Dexter ..... B60P 7/00

* cited by examiner

COVID SAFE COOLING SYSTEMS

CROSS-REFERENCE TO RELATED APPLICATIONS

This application claims priority to provisional application 63/027,499 filed on May 20, 2020 and is incorporated herein by reference in its entirety.

FIELD OF THE INVENTION

The present invention relates generally to coolers, and more particularly, to covid protection cooler systems, which utilize multiple individualized beverage dispensing ports to minimize transmission of communicable diseases.

BACKGROUND OF THE INVENTION

Many methods and devices have been used unsuccessfully attempting to efficiently and effectively provide simple and easy to use systems to minimize transmission of communicable diseases while delivering beverages to individuals. Several devices, systems and methods have been created attempting unsuccessfully to address the problem having beverages delivered to individuals while minimizing direct and incidental contact between a server, serving mechanism, and other individuals while obtaining a beverage. The repeated contact between individuals and beverages other than own, also create transmission methods between individuals obtaining a beverage and other beverages which will subsequently be obtained by other individuals and create unwanted communicable disease transmission pathways.

Further, previous methods utilized to minimize covid transmissions have been expensive and cumbersome to utilize. Quite often, extra personnel and additional equipment are needed to disburse required beverages which render the process more time consuming and expensive.

In the United States alone there are numerous businesses that are opening post covid19 triage activities that require personnel to engage in new procedures and to don personnel protective equipment (PPE) in order to serve beverages. Recently, the coronavirus pandemic has required numerous personnel to don protective gear including facemasks and respirator masks, in various industries, which make distribution of beverages to individuals difficult. These additional pieces of PPE result in additional expenses and make delivery of beverages to individuals cumbersome.

Accordingly, there is an established need for protective systems which solve at least one of the aforementioned problems. Further, there is an established need for covid protection cooler systems which can be utilized more efficiently and effectively and provide mechanisms to deliver beverages while minimizing transmission of communicable diseases.

SUMMARY OF THE INVENTION

The present invention is directed to innovative and cost-effective devices, systems, and methods of manufacturing, covid protection cooler systems. Further, the present invention is directed to an innovative, ergonomically designed, covid protection cooler systems which reduce physical contact between personnel and individual beverages while dispersing beverages to individuals.

A covid protection cooler system is provided. The system includes a five-panel sided box structure. The system also includes a top panel connected to the box structure with back side hinges connecting the top panel to a back side panel of the box structure and side hinges connecting the top panel to left-hand side and right-hand side panels of the box structure, wherein a connection point of the side hinges are positionable about an exterior midsection of the right-hand and left-hand side panels and another connection point of the side hinges connect with the top panel about a midpoint of an outer edge of the top panel and designed to allow the top panel to swivel up and down between open and closed positions such that the top panel remains connected with the left-hand side and right-hand side panels and the top panel is connected to the back side panel with the back side hinges. The system further includes a lock hasp wherein a connection point of the lock hasp connects to a front outer surface of the top panel and another connection point of the lock hasp connects to a front outer surface of a front panel. Additionally, the system includes a plurality of openings on the top panel.

The system includes a plurality of cylindrical container holders affixed to an interior top surface of a bottom side panel of the box structure, wherein the plurality of container holders are aligned with the plurality of openings on the top panel and arranged such that when the top panel is positioned on top of the box structure and structured such that when the top panel rests on top surfaces of the left-hand side, right-hand, back side, and front side panels the openings on the top panel and the container holders are aligned to allow beverage containers to be stored within the container holders and to be removed from the system by users of the system and wherein an outer vertical circumferential surface of the plurality of container holders and interior surfaces of the right-hand, left-hand, bottom side, back side and front side panels form an interior ice chamber, the ice chamber arranged such that the ice chamber can be replenished with ice when the top panel is in an extended open position and held open by the side hinges and maintained in position with the box structure with the back side hinges and wherein the ice chamber is enclosed by interior surfaces of the top panel, front side panel, the bottom side panel, back side panel, right-hand side panel and left-hand side panel when the top panel is in a closed position when the top panel rests on the upper surfaces of the front side, back side, right-hand side and left-hand side panels.

The system also includes an interior water barrier liner covering interior surfaces of the ice chamber. The system further includes a plurality of drain ports within the plurality of container holders configured to allow draining of fluids from the plurality of container holders and cleaning of the plurality of container holders wherein the plurality of drain ports form a free communication pathway between an interior of the container holders and the ice chamber. Additionally, the system includes a plurality of fasteners designed to affix the five-panel box structure together. The system further includes a drain plug positionable on an under side of the bottom side panel, the drain plug configured to allow fluids from the ice chamber to be drained from the system.

The system can also include an x-frame dolly transportation device.

The system can further include a rail movement system wherein the rail movement system includes a drawer slide system configured and sized to be placed within an interior of a pickup truck cargo bed and arranged to allow the cooler system to extend beyond a tailgate of the pickup truck allowing access to the cooler system by users.

In an embodiment of the present invention, the covid protection system can include materials such as Polylactic acid (PLA).

In another embodiment, the system can also include Thermoplastic polyurethane (TPU).

In an aspect, the system can include materials such as, but not limited to wood, ceramic, metal, composites, and/or synthetic materials designed such that the system can be easily maneuvered and transported.

In another aspect, the system can also include an anti-microbial coating.

In yet another aspect, the system can include construction worker interfaces, the interfaces structured to receive and/or affix tools to the system, while dispensing beverages.

In an embodiment, a method for manufacturing the system can include laser processes for cutting material.

In an embodiment, the system can include rectangular, oval, trapezoidal, circular, and/or other multi-sided shapes. In embodiments, the shape of the system can be configured to interface with a vehicle such as, but not limited to a pick-up truck, a forklift, a Bobcat®, food truck, crane, pushcart and/or wheel barrel.

In another embodiment, the system can also include materials, such as but not limited to aluminum, steel, composites, synthetic plastics, rubber, rope, and/or leather. The material structured to provide resistance to infectious diseases, water resistance and/or anti-microbial properties.

In yet another embodiment, the system can include manufacturing methods such as but not limited to 3-D printing, injection molding, laser cutting, CNC processes, extrusion, dye cutting and/or stamping, hand cutting, sawing and wood working. The methods configured to minimize production time and/or cost.

In an aspect, the system can include coating materials. The coating materials arranged to mitigate microbial and/or viral transmission. Further, the coatings can be configured to retard moisture and/or eliminate unwanted biological growth.

In another embodiment, the system can also include polypropylene configured to produce the system with injection molding. Further, the system can include leather, the leather utilized for undercoating of the system arranged to minimize snagging of edges on adjacent material.

In yet another embodiment, the system can include features suited for a construction area. These features include, but are not limited to, dust-off areas, misting areas, blow-off areas.

In an aspect, the system can include insulating layers, the layers configured to maintain temperature of beverages within a desired range.

In another aspect, the system can be configured to allow individuals to select a beverage without coming into contact with beverages other than their own.

In yet another aspect, the system can include single serving beverage container ports configured to be positionable on push carts for restaurant use.

In embodiments, the system can include portable single system operator systems designed to be portable with one person and to be transported up and down stairs in sporting event venues.

In another embodiment, the system can also include touchless payment systems.

In yet another embodiment, the system can include sensors to disperse aerolized alcohol when a person is reaching out to grab a beverage.

In an aspect, the system can include anti-microbial coatings designed to retard disease transmission.

In another aspect, the system can also include ultraviolet lamps that are aimed at the system surfaces and beverages so as to kill any transmitting disease that may find its way onto the surfaces of the system and/or beverages.

In yet another aspect, the system can include multiple trays, so that they can be pre-loaded before coming on-site and have the vendor open up another tray when a current one is empty. The trays may be arranged in a horizontal fashion and stacked in a vertical manner, much like dresser drawers.

In embodiments, the system can include sacrificial plastic layers positionable on a top surface of the system. A plurality of plastic layers can be placed upon the top surface of the system and would cover the surface area where a beverage or container opening does not exist. The plastic layers can be removed during system refilling evolutions thereby minimizing transmission of any viral or bacterial infection to users of the system if incidental contact would occur between users of the system and the system top surface. Upon removal of a top plastic layer of a plurality of stacked plastic layer the plastic layer beneath the one being removed would be a sanitary surface that has not had any contact with anyone.

In embodiments, the system can include an x frame dolly with handles to facilitate movement of the system at a work site.

In embodiments, the system can include a rail carriage mechanism positionable within a back of a pickup truck and would operate like a dresser drawer in that the system would slide on the rails and can be extended when the pickup truck is stationary and in position to be deployed.

These and other objects, features, and advantages of the present invention will become more apparent from the attached drawings and the detailed description of the preferred embodiments, which follow. It is understood that the drawings are designed for the purposes of illustration and not as a definition of the limits of the embodiments of the present invention. It should be further understood that the drawings are not necessarily drawn to scale and are merely intended to conceptually illustrate the methods and systems described herein.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
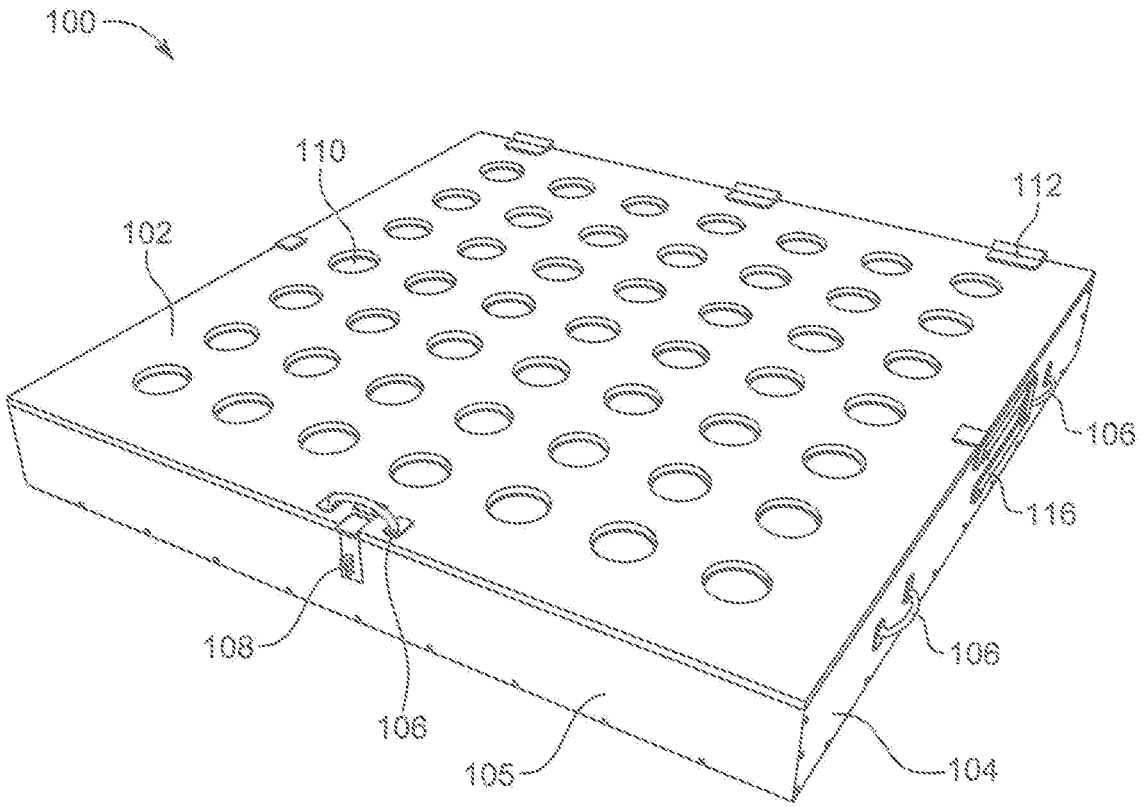
FIG. 1 presents a top front perspective view of an embodiment of the system.

Referring initially to FIG. 1, a top right hand side perspective view of an embodiment of a Covid Protection Cooler System 100 is presented. The system 100 can include a six-sided enclosure. The system can include a top panel 102. The system can also include a right-hand side panel 104. Further, the system can include handles 106 positionable on the system 100 to allow for portability of the system 100. The system can include a front side panel 105 wherein a lock hasp 108 can be positionable on both the top panel 102 and the front panel 105 and configured to allow securing access to an interior of the system 100. The top panel 102 can include a plurality of openings 110 situated throughout the top panel 102 and arranged to allow containers to be stored within system 100.

Figure 2:
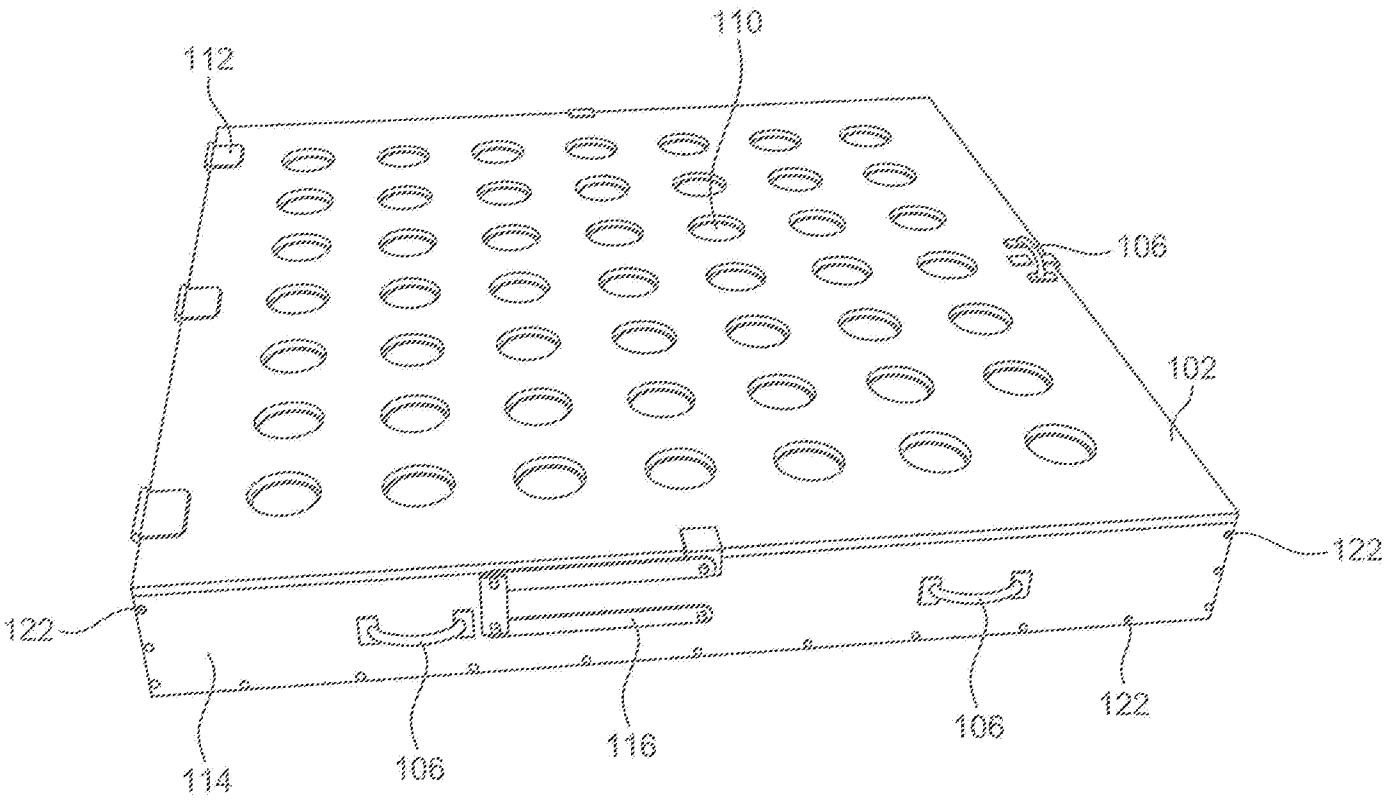
FIG. 2 presents a top left hand side perspective view of an embodiment of the system.

Turning to FIG. 2, a top left hand side perspective view of an embodiment of the system 100 is shown. The system can include backside hinges 112 positionable on the top panel 102 and the back side panel 120 and configured to allow the top panel 102 to swing up and pivot up at a connection point between the top panel 102 and the back side panel 120 allowing access to the interior of the system for replenishing ice, water, or other mediums intended to control temperature of the beverage containers stored within the system 100. The system can include side hinges 116 positionable on sides of the system such as the right-hand side panel 104 and a left-hand side panel 114.

Figure 3:
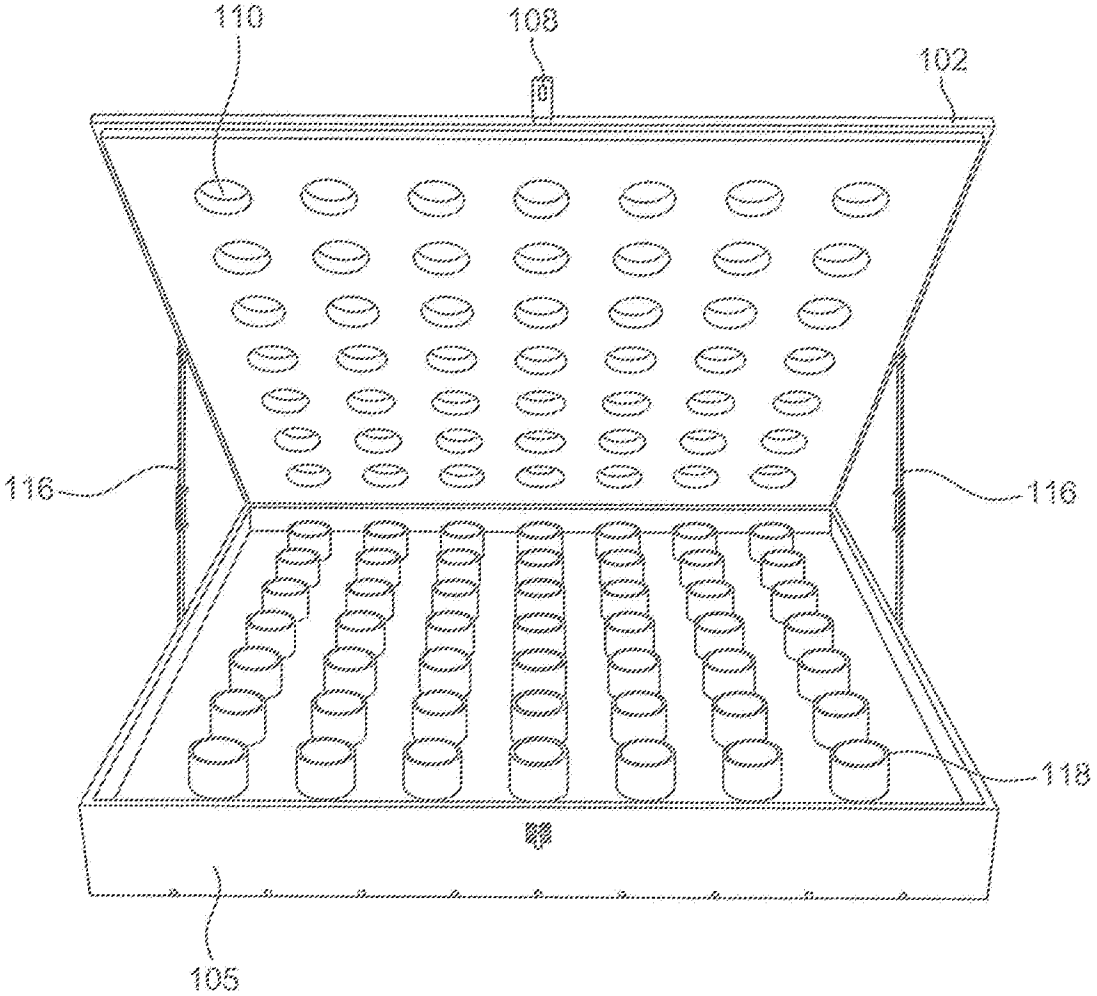
FIG. 3 presents a top front perspective view of a system in with a top panel in an open position in an embodiment of the system.

As best seen in FIG. 3, the system 100 can be opened providing access to the interior of the system 100. As shown, the front side panel 105 can connect to both right-hand side and left-hand side panels 104 and 114. Further, the side hinges 116 can be located about a midpoint on the right-hand side and left-hand side panels 104 and 114. Situated within the system can be container holders 118 affixed to a top surface of a bottom side panel 126 structured to keep beverage containers in position for alignment with the top side panel 102 so that when the top side panel 102 is lowered and closed, the openings 110 are in alignment with the container holders 118.

Figure 4:
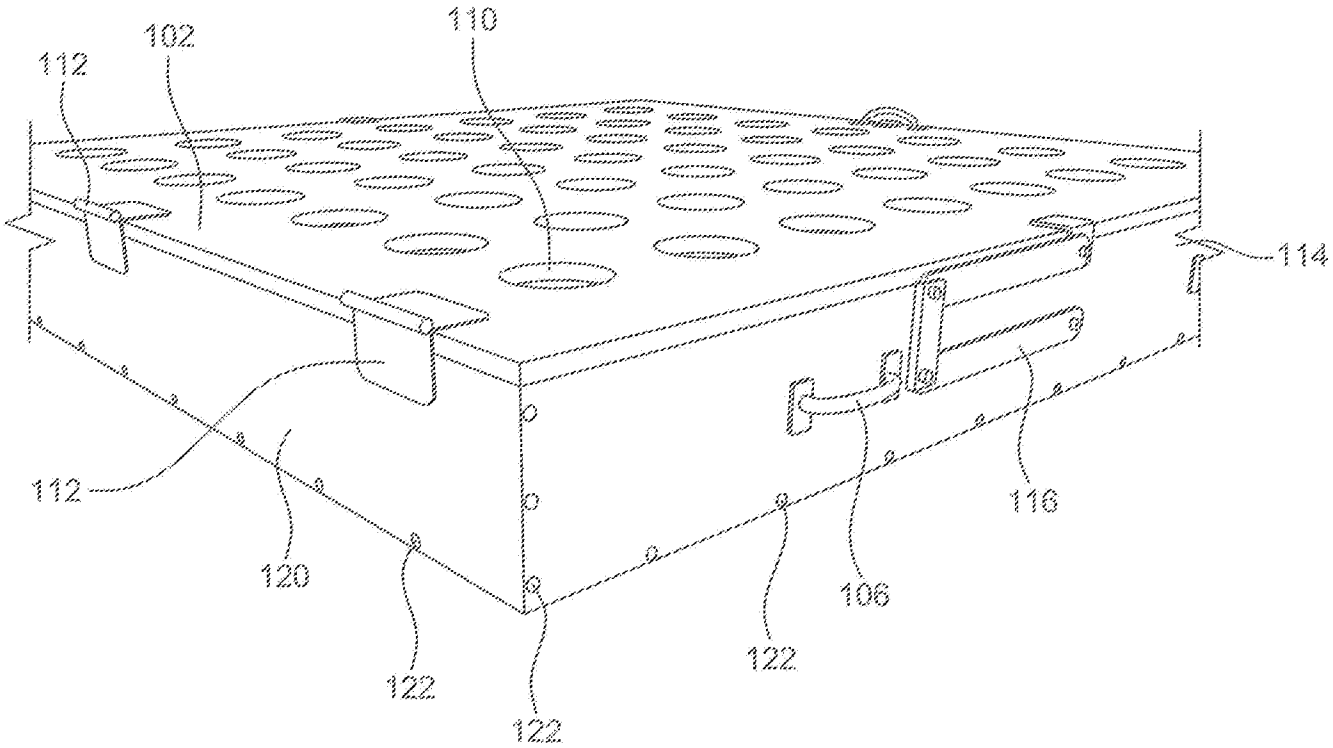
FIG. 4 presents a back top left-hand side perspective view of an embodiment of the present invention.

Referencing FIG. 4, The system 100 can include a back side panel 120. The back side panel 120 as well as the right-hand side, left-hand side and bottom panels 104, 114 and 126 can be connected with fasteners 122. The fasteners can include drywall screws as well as other fastening devices.

Figure 5:
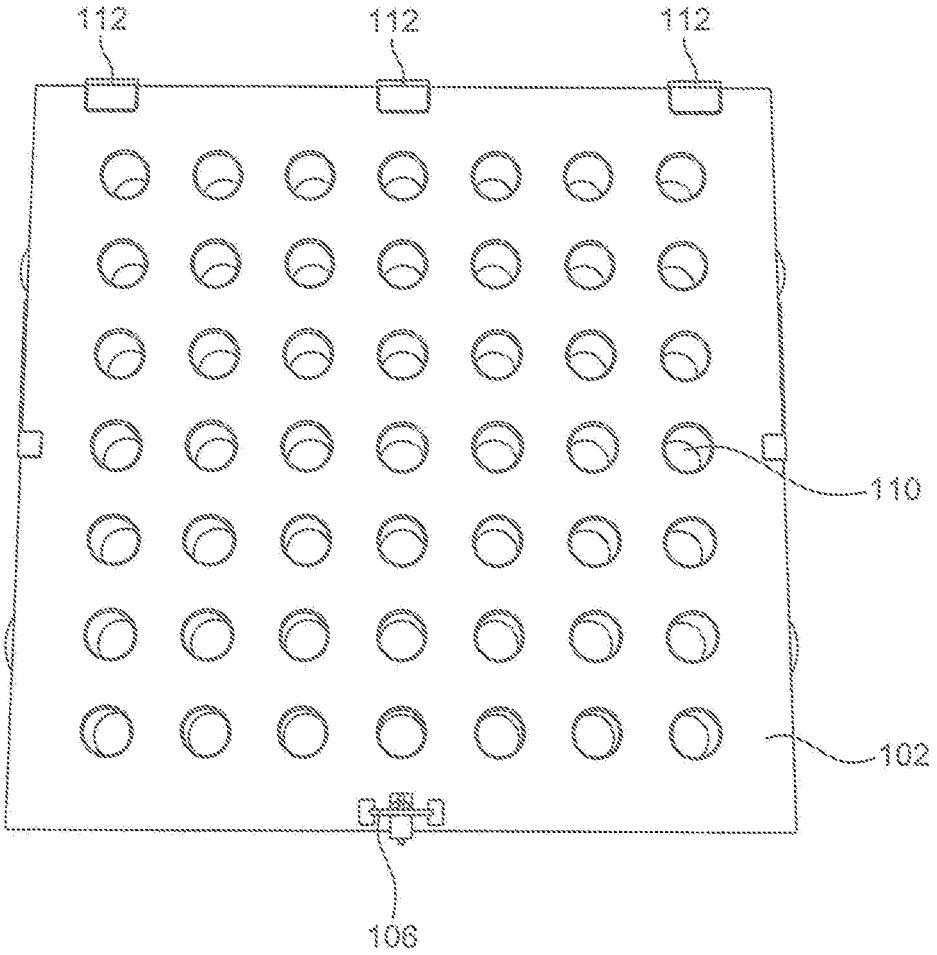
FIG. 5 presents a top view of a system in an embodiment of the system.

FIG. 5 illustrates a top view of the system 100. The system can include back side hinges 112 connecting the top panel 102 to the back side panel 120.

Figure 6:
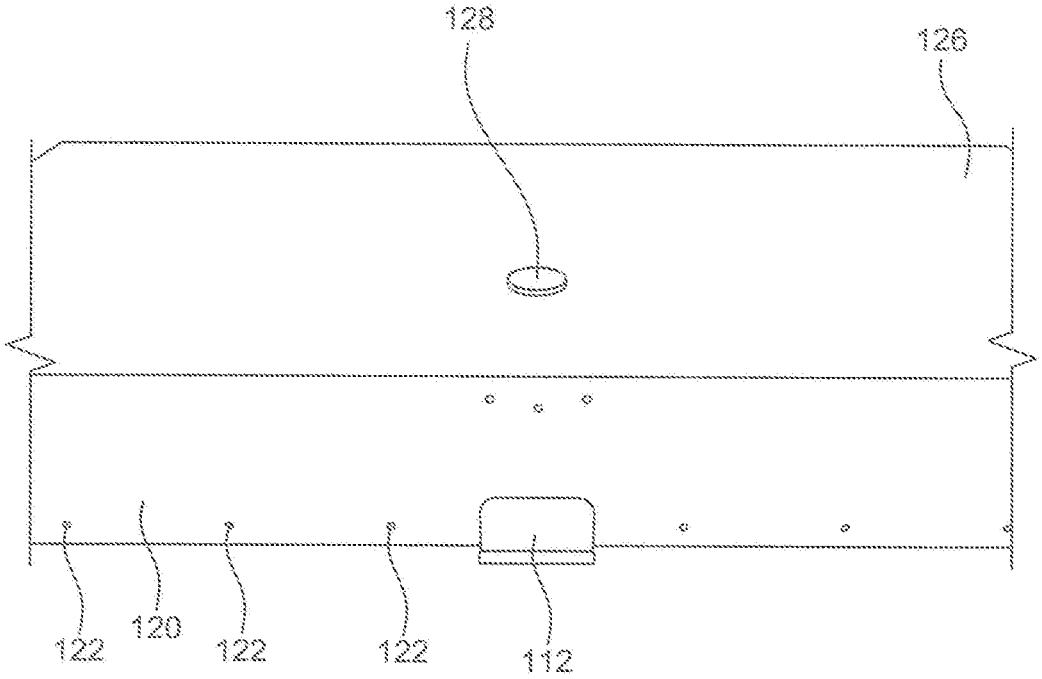
FIG. 6 presents a bottom side perspective view of a system displaying a drain plug in an embodiment of the present invention.

FIG. 6 shows a back side bottom perspective view of an embodiment of the system. The bottom side panel 126 can include a drain plug 128 positionable on a surface of the bottom side panel and configured to allow draining of the system 100.

Figure 7:
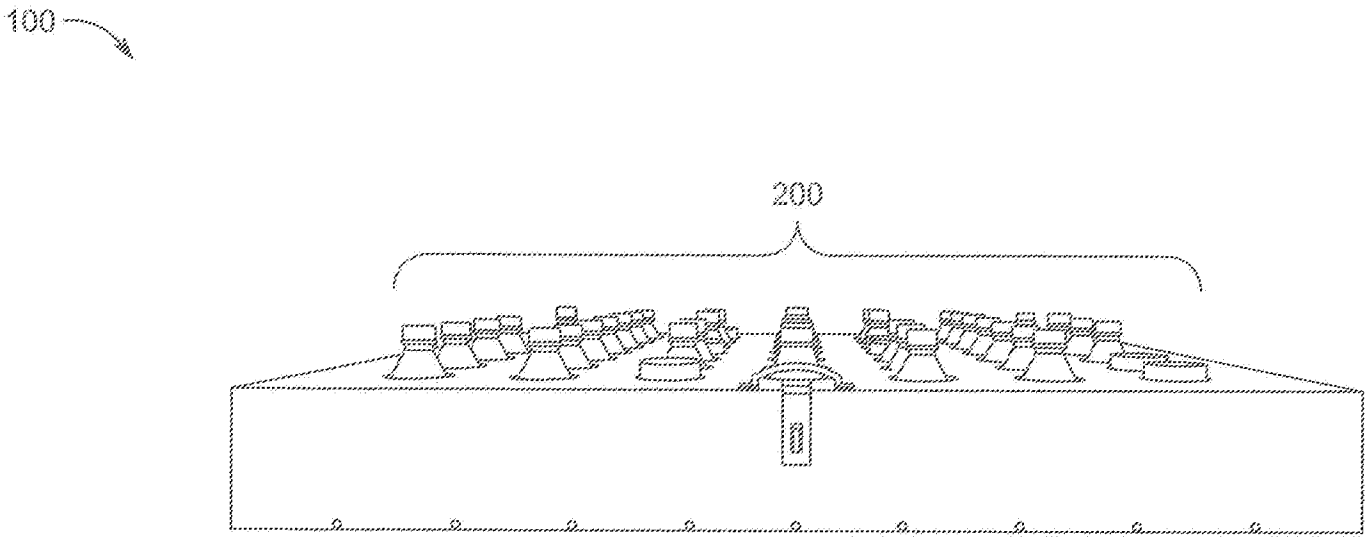
FIG. 7 presents a front side view of a system with beverage containers in an embodiment of the system.

FIG. 7 displays an embodiment of the present invention with beverage containers 200 stored within the system 100.

Figure 8:
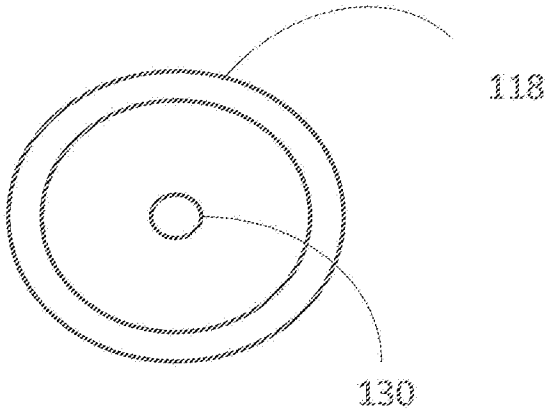
FIG. 8 presents a top view of a container holder displaying a drain port in an embodiment of the present invention.

FIG. 8 illustrates a top view of a cylindrical container holder 118 with a drain port 130 positionable about a centerline of the container holder with the drain port allowing for fluid to flow from an interior of a container holder into the ice chamber allowing for draining of fluids and for cleaning of the system including ice chamber and container holders.

In embodiments not shown, the system can include container holders 118 with perforations 130 at a bottom of the holders 118. The perforations 130 can be designed to allow draining of the container holders 118 and the interior of the system 100 where ice may be placed in order to cool beverages that are being stored in the system 100.

While the written description of the exemplary embodiments enables one of ordinary skill to make and use what is considered presently to be the best mode thereof, those of ordinary skill will understand and appreciate the existence of variations, combinations, and equivalents of the specific embodiment, method, and examples herein. The exemplary embodiments should therefore not be limited by the above-described embodiment, method and examples, but all embodiments and methods within the scope and spirit of the exemplary embodiments as claimed.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A covid protection cooler system comprising:

a five-panel sided box structure;

a top panel connected to the box structure with back side hinges connecting the top panel to a back side panel of the box structure and side hinges connecting the top panel to left-hand side and right-hand side panels of the box structure, wherein a connection point of the side hinges are positionable about an exterior midsection of the right-hand and left-hand side panels and another connection point of the side hinges connect with the top panel about a midpoint of an outer edge of the top panel and designed to allow the top panel to swivel up and down between open and closed positions such that the top panel remains connected with the left-hand side and right-hand side panels and the back side panel, wherein the side hinges are structured to place the top panel in an extended open position and to hold open the top panel, allowing an operator to replenish ice and beverages, while the hinges keep the top panel in the extended open position;

a lock hasp wherein a connection point of the lock hasp connects to a front outer surface of the top panel and another connection point of the lock hasp connects to a front outer surface of a front panel;

at least 24 cylindrical openings on the top panel;

at least 24 container holders affixed to an interior top surface of a bottom side panel of the box structure, wherein a centerline to centerline distance between all of the at least 24 of the container holders are about six inches, and configured to prevent inadvertent contact between users of the system and unintended containers while the containers are positioned within the at least 24 container holders, wherein the at least 24 container holders are aligned with the at least 24 openings on the top panel and arranged such that when the top panel is positioned on top of the box structure and structured such that when the top panel rests on top surfaces of the left-hand side, right-hand, back side, and front side panels the at least 24 openings on the top panel and the at least 24 container holders are aligned to allow beverage containers to be stored within the container holders and to be removed from the system by users of the system and wherein an outer vertical circumferential surface of the plurality of container holders and interior surfaces of the right-hand, left-hand, bottom side, back side and front side panels form an interior ice chamber, the ice chamber arranged such that the ice chamber can be replenished with ice when the top panel is in an extended open position and held open by the side hinges and maintained in position with the box structure with the back side hinges and wherein the ice chamber is enclosed by interior surfaces of the top panel, front side panel, the bottom side panel, back side panel, right-hand side panel and left-hand side panel when the top panel is in a closed position when the top panel rests on the upper surfaces of the front side, back side, right-hand side and left-hand side panels;

an interior water barrier liner covering interior surfaces of the ice chamber;

a plurality of perforations within the plurality of container holders configured to allow draining of fluids from the plurality of container holders and cleaning of the plurality of container holders wherein the plurality of perforations form a free communication pathway between an interior of the container holders and the ice chamber;

at least two portability handles positioned on a left-hand side and a right-hand side of the box structure configured to allow the covid protection cooler system to be transported manually by at least two people;

wherein the system includes plastic surfaces structured to provide resistance to infectious diseases;

wherein the dimensions of the system are sized to occupy a substantial portion of a lineal distance across a width of a standard pickup truck cargo bed;

and wherein the system is designed to be opened and closed for replenishing, while resting on the standard pickup cargo bed, from a rear side of the standard pickup truck cargo bed;

a plurality of fasteners designed to affix the five panel box structure together;

and wherein the at least 24 container holders, the six inch centerline distances between the container holders, the plastic surfaces, the at least two handles on the right hand and left hand sides of the box structure configured to allow the covid protection cooler system to be transported manually by at least two people, the dimensions of the system are sized to occupy the substantial portion of the lineal distance across the width of the standard pick up truck cargo bed, and designed to be opened and closed from the rear side of the cargo bed, are all in totality designed to mitigate COVID transmissions at construction sites at watering points; and a drain plug positionable on an under side of the bottom side panel, the drain plug configured to allow fluids from the ice chamber to be drained from the system.

* * * * *